US008600263B2

(12) United States Patent
Yamamoto et al.

(10) Patent No.: US 8,600,263 B2
(45) Date of Patent: Dec. 3, 2013

(54) IMAGE FORMING APPARATUS WITH TRANSPORT TOOL FOR SEPARATING A FIRST ROLLER AND A SECOND ROLLER OF A FEED ROLLER UNIT DURING TRANSPORT OF THE IMAGE FORMING APPARATUS

(75) Inventors: Tomoya Yamamoto, Aichi (JP); Junki Ueyama, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 163 days.

(21) Appl. No.: 13/166,191

(22) Filed: Jun. 22, 2011

(65) Prior Publication Data

US 2011/0311268 A1 Dec. 22, 2011

(30) Foreign Application Priority Data

Jun. 22, 2010 (JP) ..... 2010-141158
Mar. 17, 2011 (JP) ..... 2011-058854

(51) Int. Cl.
*G03G 21/16* (2006.01)
*G03G 15/00* (2006.01)

(52) U.S. Cl.
USPC ..... 399/111; 399/107

(58) Field of Classification Search
USPC ..... 399/111, 107
See application file for complete search history.

(56) References Cited

U.S. PATENT DOCUMENTS 5,258,811 A * 11/1993 Miyake et al. ..... 399/167
5,740,491 A 4/1998 Imai
6,240,268 B1 * 5/2001 Nishiuwatoko ..... 399/119
6,411,789 B1 * 6/2002 Okabe et al. ..... 399/113
2006/0127126 A1 * 6/2006 Kim ..... 399/106
2007/0048008 A1 3/2007 Kamimura (Continued)

FOREIGN PATENT DOCUMENTS

EP 2 098 917 A1 9/2009
JP 05107979 A * 4/1993

(Continued)

OTHER PUBLICATIONS

Extended European Search Report and Search Opinion dated May 10, 2012 from related European Patent Application No. 11167331.5.

(Continued)

*Primary Examiner* — David Gray
*Assistant Examiner* — Tyler Hardman
(74) *Attorney, Agent, or Firm* — Scully, Scott, Murphy & Presser, PC

(57) ABSTRACT

An image forming apparatus is provided, which includes a main body including two first frames facing each other and a second frame bridging a gap between the first frames, an image forming unit disposed between the first frames, a feed roller unit including a first roller and a second roller supported by the second frame so as to contact the first roller in a position away from the first frame, an urging member providing an urging force to bring the first roller into contact with the second roller in a direction parallel to the first frames, and a spacer detachably attached between the main body and one of the first and second rollers near at least one of the first frames, so as to separate the first roller from the second roller or weaken a contact force between the first roller and the second roller against the urging force.

22 Claims, 11 Drawing Sheets

(56) References Cited

U.S. PATENT DOCUMENTS

| | | | | |
|---|---|---|---|---|
| 2008/0253800 | A1* | 10/2008 | Uratani et al. | 399/113 |
| 2008/0309206 | A1* | 12/2008 | Kondo | 312/107 |
| 2009/0297219 | A1* | 12/2009 | Yoshino et al. | 399/114 |
| 2011/0229194 | A1* | 9/2011 | Okabe et al. | 399/110 |

FOREIGN PATENT DOCUMENTS

| | | | |
|---|---|---|---|
| JP | HEI 5-232751 | A | 9/1993 |
| JP | HEI 6-102714 | A | 4/1994 |
| JP | HEI 6-148965 | A | 5/1994 |
| JP | HEI 9-244484 | A | 9/1997 |
| JP | 2006-58459 | A | 3/2006 |
| JP | 2006-347645 | A | 12/2006 |
| JP | 2007-57646 | A | 3/2007 |
| JP | 2008-309992 | A | 12/2008 |
| JP | 2009-251201 | A | 10/2009 |

OTHER PUBLICATIONS

Notification of Reasons for Rejection from Japanese Patent Application No. 2011-058854 dated Sep. 3, 2013, together with an English language translation.

* cited by examiner

IMAGE FORMING APPARATUS WITH TRANSPORT TOOL FOR SEPARATING A FIRST ROLLER AND A SECOND ROLLER OF A FEED ROLLER UNIT DURING TRANSPORT OF THE IMAGE FORMING APPARATUS

CROSS-REFERENCE TO RELATED APPLICATION

This application claims priority under 35 U.S.C. §119 from Japanese Patent Applications No. 2010-141158 filed on Jun. 22, 2010 and No. 2011-058854 filed on Mar. 17, 2011. The entire subject matters of the applications are incorporated herein by reference.

BACKGROUND

1. Technical Field

The following description relates to one or more techniques concerning an image forming apparatus, in particular, to one or more techniques concerning a configuration of the image forming apparatus during transport and a transport tool employed for transporting the image forming apparatus.

2. Related Art

So far, an image forming apparatus has been known, which includes a pair of frames disposed to face each other and an intermediate frame disposed to bridge a gap between the frames. The known image forming apparatus further includes a pair of feed rollers, such as registration rollers, which are pressed by each other so as to nip and feed a sheet. Especially, the registration rollers are pressed with a relatively high pressing force, so as to once regulate the leading end of the sheet to be conveyed in a state where the registration rollers are stopped (not driven). Further, in the known image forming apparatus, one of the registration rollers is supported by the intermediate frame and pressed by the other one toward the intermediate frame.

SUMMARY

In the known image forming apparatus configured as above, when the intermediate frame is formed from resin, the following problem might be caused. That is, for example, when the image forming apparatus is exposed to a high-temperature environment for a long time during transport, the intermediate frame might be creep-deformed by the pressing force applied between the feed rollers. Thereby, a relative positional relationship between the feed rollers might be changed so much that the feed rollers cannot appropriately feed a sheet. Further, when at least one of the feed rollers is formed from resin, the at least one feed roller itself might be deformed so much that the feed rollers cannot appropriately feed a sheet.

Aspects of the present invention are advantageous to provide one or more improved techniques for an image forming apparatus, which techniques make it possible to prevent deformation of the frames and the feed rollers even though the image forming apparatus is exposed to a high-temperature environment for a long time during transport.

According to aspects of the present invention, an image forming apparatus is provided, which includes a main body including two first frames disposed to face each other and a second frame disposed to bridge a gap between the two first frames, an image forming unit disposed between the two first frames, a feed roller unit configured to feed a sheet passing through the image forming unit in a sheet feeding direction, the feed roller unit including a first roller having a first rotational axis line extending in such a direction as to bridge the gap between the two first frames, and a second roller having a second rotational axis line substantially parallel to the first rotational axis line, the second roller being supported by the second frame, so as to contact the first roller in a position away from the first frame, an urging member configured to provide an urging force in an urging direction substantially parallel to the first frames so as to bring the first roller and the second roller into contact with each other, and a spacer detachably attached between the main body and one of the first roller and the second roller, in the vicinity of at least one of the first frames, so as to separate the first roller from the second roller or weaken a contact force between the first roller and the second roller, against the urging force provided by the urging member.

According to aspects of the present invention, further provided is an image forming apparatus, which includes a main body including two first frames disposed to face each other and a second frame disposed to bridge a gap between the two first frames, an image forming unit disposed between the two first frames, a feed roller unit configured to feed a sheet passing through the image forming unit in a sheet feeding direction, the feed roller unit including a first roller having a first rotational axis line extending in such a direction as to bridge the gap between the two first frames and a second roller having a second rotational axis line substantially parallel to the first rotational axis line, the second roller contacting the first roller, the second roller being partially exposed to a side of the first roller through an opening formed on a feed surface provided on the second frame to feed thereon the sheet fed by the feed roller unit, an urging member configured to provide an urging force in an urging direction substantially parallel to the first frames so as to bring the first roller and the second roller into contact with each other, and a spacer detachably attached between the first roller and at least one of the feed surface and an extension surface of the feed surface, so as to separate the first roller from the second roller or weaken a contact force between the first roller and the second roller, against the urging force provided by the urging member.

According to aspects of the present invention, further provided is a transport tool for transporting an image forming apparatus that includes an image forming unit, a feed roller unit configured to feed a sheet passing through the image forming unit in a sheet feeding direction, the feed roller unit including a first roller and a second roller, the first roller being urged in such a direction as to contact the second roller, and a frame supporting the image forming unit and the feed roller unit. The transport tool includes a spacer configured to be detachably attached between the first roller and the frame so as to separate the first roller from the second roller or weaken a contact force between the first roller and the second roller.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, embodiments in which aspects of the present invention are applied to a laser printer will be described in detail with reference to the accompany drawings. In the following description, initially, a schematic configuration of the laser printer will be described. After that, specific features of the present inventions will be described in detail.

<First Embodiment>

<Configuration of Laser Printer>

Figure 1:
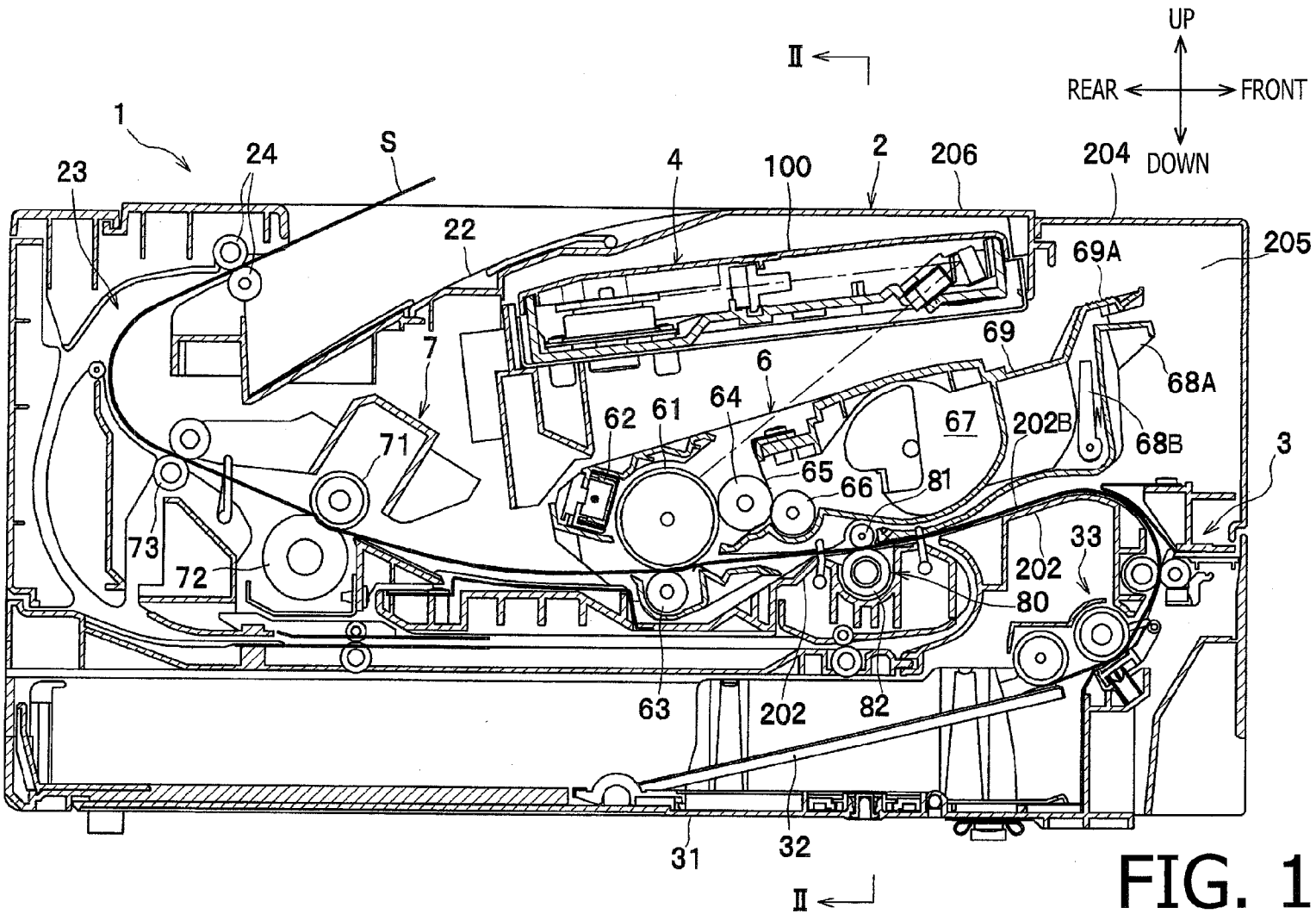
FIG. 1 is a cross-sectional side view showing an internal configuration of a laser printer in a first embodiment according to one or more aspects of the present invention.

As shown in FIG. 1, a laser printer 1 of a first embodiment according to aspects of the present invention includes a sheet feeding unit 3 for feeding a sheet S and an image forming unit 4 for forming an image on the sheet S inside a main body 2.

It is noted that in the following description, an up-to-down direction, a front-to-rear direction, and a left-to-right direction of the laser printer 1 will be defined as indicated in FIG. 1 and other relevant drawings.

The sheet feeding unit 3, which is disposed in a lower section inside the main body 2, includes a feed tray 31, a sheet pressing plate 32, and a sheet feeding mechanism 33. The sheet S placed in the feed tray 31 is lifted up by the sheet pressing plate 32 and fed toward the image forming unit 4 by the sheet feeding mechanism 33.

The image forming unit 4 includes an optical scanning unit 100, a process cartridge 6, and a fixing unit 7.

The optical scanning unit 100, which is disposed in an upper section inside the main body 2, is configured to emit a laser beam based on image data, render the laser beam incident onto a circumferential surface of the photoconductive drum 61 through a polygon mirror, a lens, and a mirror (shown with reference characters thereof omitted, see an alternate long and short dash line in FIG. 1), and scan the circumferential surface of the photoconductive drum 61 with the laser beam at a high speed. As the optical scanning unit 100, an LED array including a plurality of LED elements aligned to face the circumferential surface of the photoconductive drum 61 may be employed.

The process cartridge 6 is disposed under the optical scanning unit 100. The process cartridge 6 includes a photoconductive drum 61, an electrification device 62, a transfer roller 63, a development roller 64, a layer thickness regulating blade 65, a supply roller 66, and a toner container 67 that accommodates toner.

In the process cartridge 6, when the circumferential surface of the photoconductive drum 61 is evenly charged by the electrification device 62 and then exposed to the laser beam emitted based on the image data by the optical scanning unit 100, an electrostatic latent image is formed on the circumferential surface of the photoconductive drum 61. In addition, the toner contained in the toner container 67 is supplied to the development roller via the supply roller 66 and carried on the development roller 64 as a thin layer of a constant thickness regulated between the development roller 64 and the layer thickness regulating blade 65.

The toner carried on the development roller 64 is supplied to the electrostatic latent image formed on the circumferential surface of the photoconductive drum 61. Thereby, the electrostatic latent image is rendered visible and a toner image is formed on the circumferential surface of the photoconductive drum 61. After that, when the sheet S fed by registration rollers 80 passes through between the photoconductive drum 61 and the transfer roller 63, the toner image formed on the photoconductive drum 61 is transferred onto the sheet S.

The fixing unit 7, which is disposed behind the process cartridge 6, includes a heating roller 71 and a pressing roller 72 disposed to face and press the heating roller 71.

The fixing unit 7 is configured to thermally fix the toner image transferred onto the sheet S while the sheet S passes through between the heating roller 71 and the pressing roller 72. The sheet S with the toner image thermally fixed thereon is fed on a feeding path 23 by feeding rollers 73, and ejected from the feeding path 23 onto a catch tray 22 by ejection rollers 24.

The process cartridge 6 includes a photoconductive body cartridge 68 and a development cartridge 69. In the photoconductive body cartridge 68, the photoconductive drum 61, the electrification device 62, and the transfer roller 63 are supported at a rear side, and the development cartridge 69 is detachably attached in a box-shaped front room. In the development cartridge 69, the development roller 64, the layer thickness regulating blade 65, and the supply roller 66 are supported. Further, in the development cartridge 69, the toner container 67 is formed. The development cartridge 69 is urged rearward against the photoconductive body cartridge 68 by an urging member 68B, such that the development roller 64 is pressed against the photoconductive drum 61.

The photoconductive body cartridge 68 includes a handle 68A, to be grasped by a user, which protrudes forward from a front wall of the photoconductive body cartridge 68 located ahead of the development cartridge 69. Further, there is a handle 69A that protrudes forward from a front wall of the development cartridge 69 so as to extend upward over the handle 68A. Namely, the handle 69A of the development cartridge 69 is placed over the handle 68A of the photoconductive body cartridge 68A.

<Configurations of Frames and Registration Rollers>

Figure 2A:
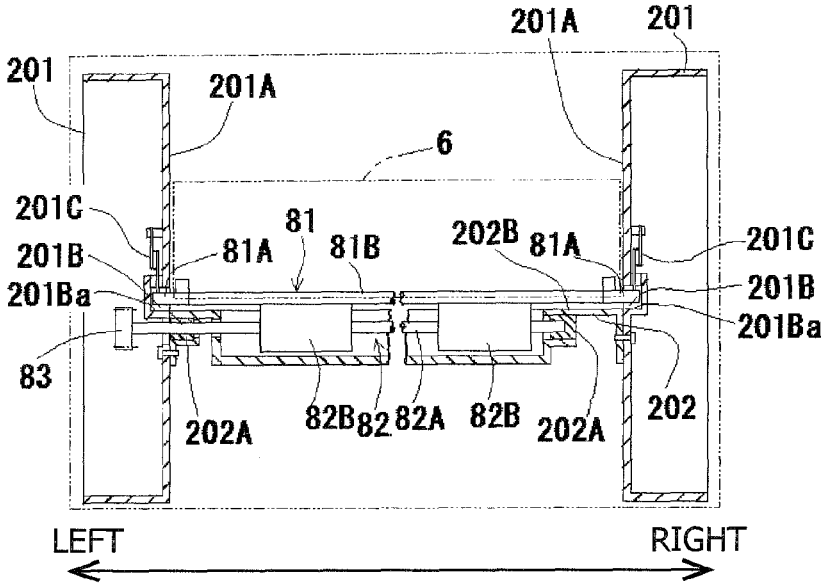
FIG. 2A is a cross-sectional view showing a frame structure of the laser printer along a II-II plane shown in FIG. 1 in the first embodiment according to one or more aspects of the present invention.

As illustrated in FIG. 2A, the main body 2 includes a pair of first frames 201 disposed to face each other in the left-to-right direction, a second frame 202 disposed to bridge a gap between the first frames 201, and an exterior cover 206 covering the first frames 201 and the second frame 202. The first frames 201, the second frame 202, and the exterior cover 206 are formed from resin material. A space between the first frames 201 is open to the outside via an opening 205 formed at a front face of the exterior cover 206. There is a front cover 204 attached in an openable and closable manner so as to cover the opening 205 when closed. The process cartridge 6 is detachably attached between the first frames 201 via the opening 205.

Figure 3:
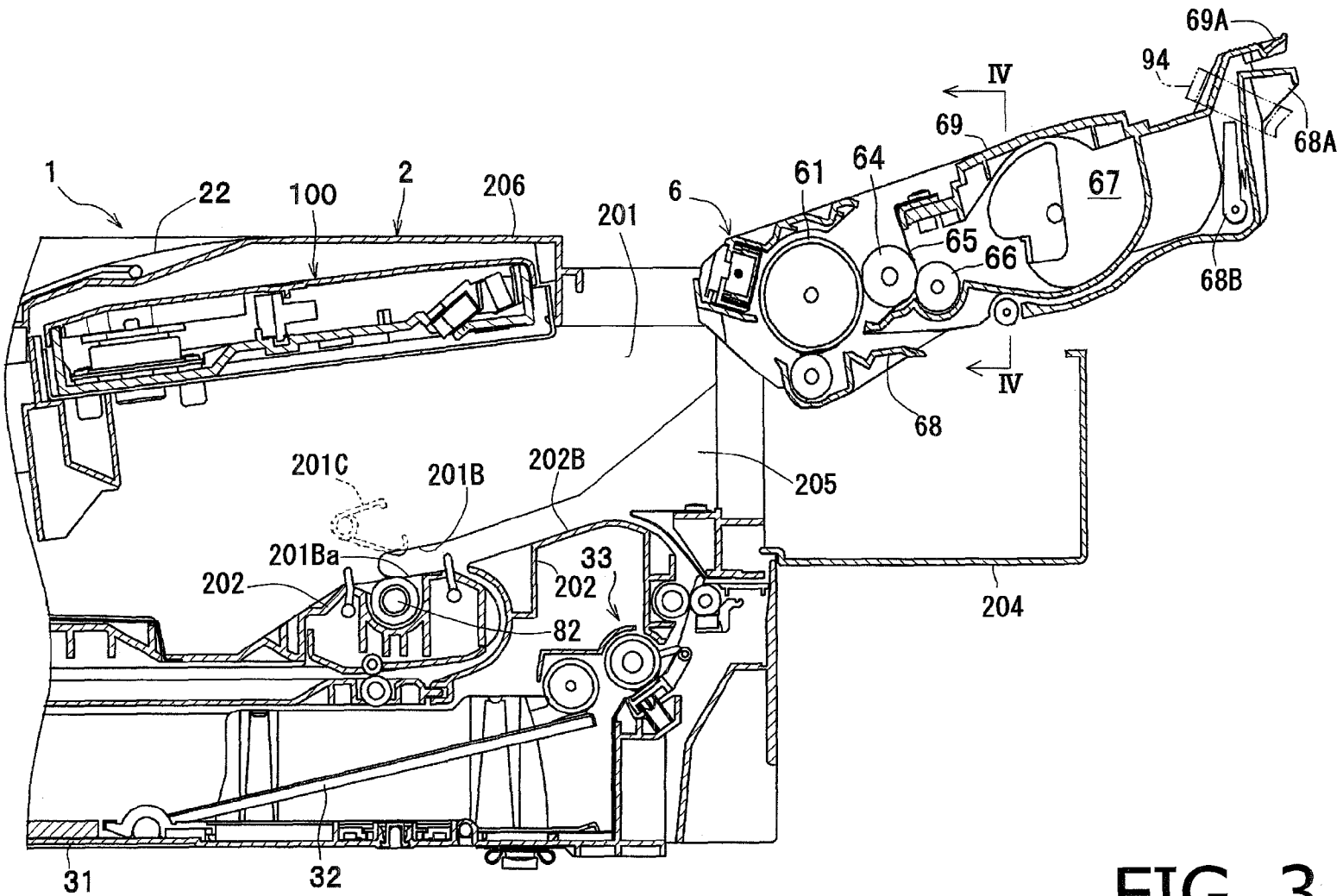
FIG. 3 is a cross-sectional side view showing a state where a cartridge is being attached to (or detached from) the laser printer in the first embodiment according to one or more aspects of the present invention.

The first frames 201 include wall surfaces 201A vertically extending parallel to each other, respectively. Each wall surface 201A includes a guide (not shown) for guiding the process cartridge 6 to be attached in a known manner, and a recessed portion 201B that is open inward so as to hold an end of a below-mentioned first roller 81. Further, as depicted in FIG. 3, the recessed portion 201B is formed with a vertical width thereof becoming wider toward the opening 205 from a portion above a below-mentioned second roller 82.

Both ends of the second frame 202 are fixed to the wall surfaces 201A of the first frames 201, for instance, with screws, respectively. The second frame 202 has an outer surface serving as a feed surface 202B for feeding thereon a sheet from the feed tray 31 to between the photoconductive drum 61 and the transfer roller 63. A lower surface 201Ba, which is a lower-side wall of the recessed portion 201B of each first frame 201, is disposed substantially on an extension plane of the feed surface 202B, in the vicinity of a below-mentioned second roller 82. In other words, the lower surface 210Ba is as high as the feed surface 202B in the vicinity of the second roller 82. When attached in a predetermined position between the first frames 201, the process cartridge 6 is placed such that a lower surface thereof faces the feed surface 202B across a predetermined distance. Thus, the process cartridge 6 forms a feeding path for the sheet S together with the feeding surface 202B.

A feed roller unit 80 is configured to feed a sheet fed from the sheet feeding unit 3 to between the photoconductive drum 61 and the transfer roller 63. The feed roller unit 80 includes a first roller 81 provided to the process cartridge 6 and a second roller 82 provided to the second frame 202. In the first embodiment, the feed roller unit 80 is configured to, when stopped, serve as registration rollers for implementing skew correction for the sheet S (namely, for correcting skew of the leading end of the sheet S when the leading end of the sheet S comes into contact with a nipping point between the first roller 81 and the second roller 82). Hereinafter, the feed roller unit 80 may be referred to as registration rollers 80.

Figure 4A:
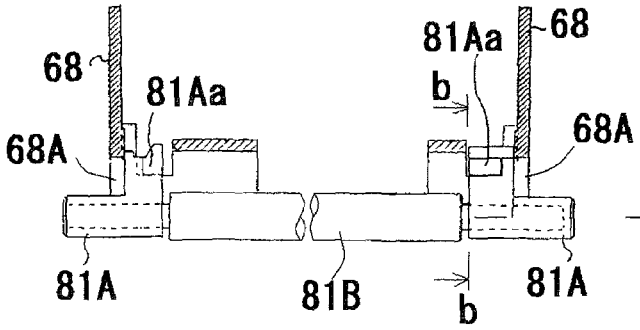
FIG. 4A is a cross-sectional view along a IV-Iv plane shown in FIG. 3 in the first embodiment according to one or more aspects of the present invention.
Figure 4B:
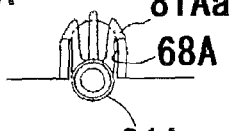
FIG. 4B is a cross-sectional view along a b-b plane shown in FIG. 4A in the first embodiment according to one or more aspects of the present invention.

The first roller 81 includes a rod-shaped roller portion 81B that has a rotational axis line along a direction extending from one of the first frames 201 to the other, and bearings 81A that rotatably support both ends of the roller portion 81B in the left-to-right direction, respectively. The roller portion 81B is formed from metal such as steel, with a constant diameter over an entire length thereof in a sheet width direction (perpendicular to a sheet feeding direction). As shown in FIGS. 4A and 4B, the bearings 81A are supported movably in the vertical direction, by long holes 68A vertically elongated that are formed on both side walls, in the left-to-right direction, of the photoconductive body cartridge 68 of the process cartridge 6. Each bearing 81A prevents the first roller 81 from dropping off the photoconductive body cartridge 68 and prevents itself from rotating, with a stopper 81Aa engaging with upper ends of both side walls of the long hole 68A in the front-to-rear direction. Further, the bearings 81A protrude outward (i.e., toward the first frames 201) from both side walls of the photoconductive body cartridge 68 in the left-to-right direction, respectively.

In the state where the process cartridge 6 is attached in the predetermined position between the first frames 201, each protruding end of the bearing 81A is inserted in the recessed portion 201B of a corresponding one of the first frames 201 and urged downward in a direction parallel to the wall surface 201A of the first frame 201 by a spring 201C disposed in the vicinity of the wall surface 201A of the first frame 201. Thereby, the roller portion 81B is brought into contact with the second roller 82 by an urging force of the spring 201C.

Figure 2B:
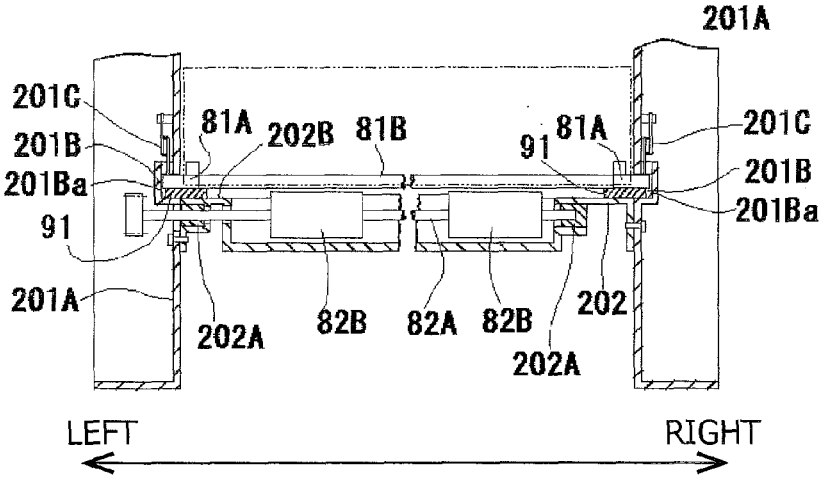
FIG. 2B is a cross-sectional view showing a frame structure of the laser printer with spacers attached thereto in the first embodiment according to one or more aspects of the present invention.

As illustrated in FIGS. 2A and 2B, the second roller 82 includes a roller shaft 82A having a rotational axis line substantially parallel to the rotational axis line of the first roller 81, and two elastic rollers 82B provided side by side in the left-to-right direction around the roller shaft 82A. Specifically, as shown in FIG. 2A, portions of the roller shaft 82A outside the two elastic rollers 82B in the left-to-right direction are rotatably supported by the second frame 202 via two bearings 202A, respectively. The right-side bearing 202A is fixed in a position a predetermined distance away leftward from the right-side first frame 201 under an upper wall of the second frame 202. A left end of the roller shaft 82A extends further leftward from the left bearing 202A, penetrates the left first frame 201, and has a gear 83 configured to receive a driving force from a driving motor (not shown). Each elastic roller 82B is disposed in a position a predetermined distance away from a corresponding one of the first frames 201, so as to protrude toward the first roller 81 via an opening formed on the feed surface 202B.

<Configuration of Transport Tool for Transporting Laser Printer>

Figure 6:
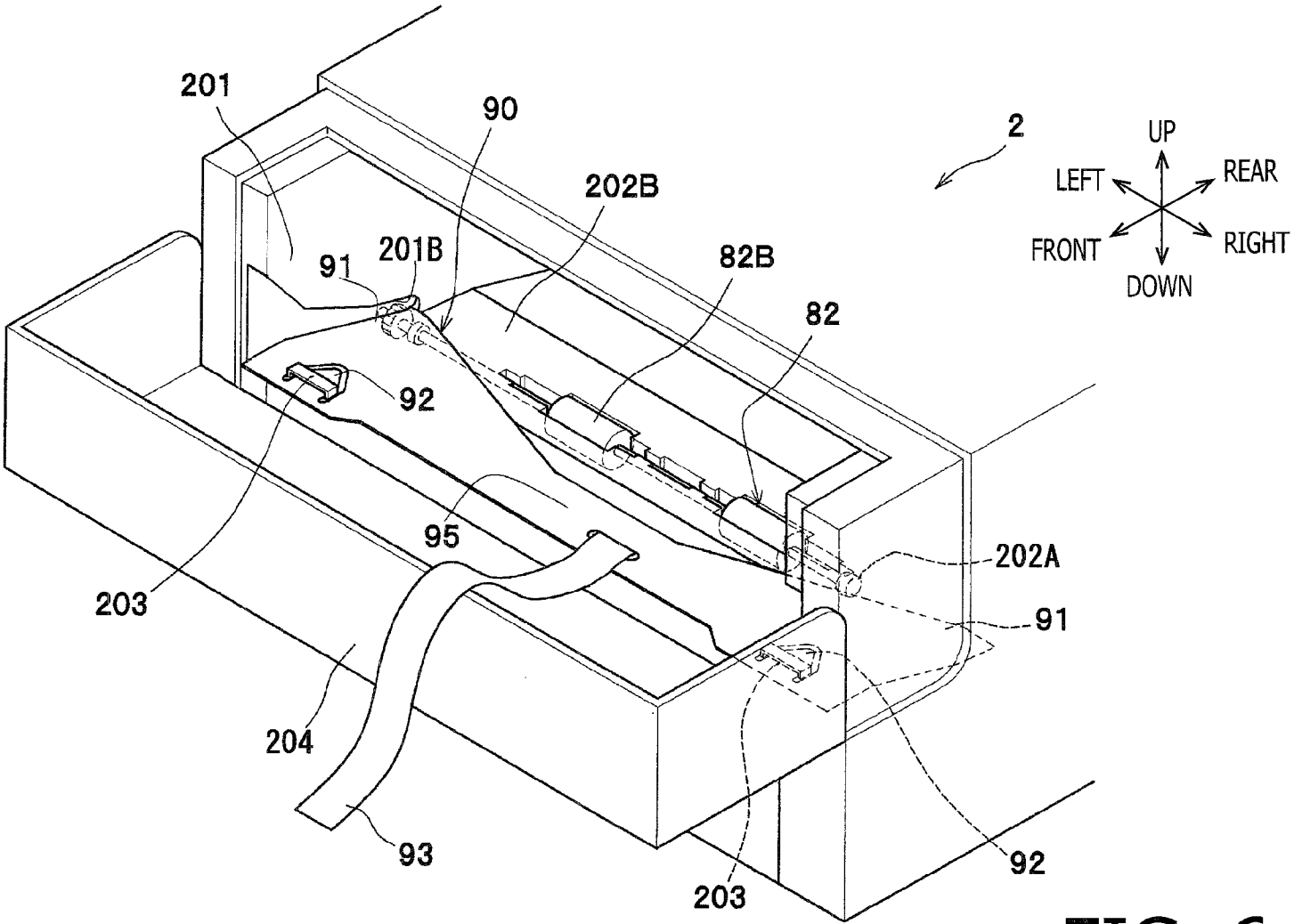
FIG. 6 is a perspective view showing the laser printer to which the spacers are attached in the first embodiment according to one or more aspects of the present invention.

A transport tool for transporting the laser printer 1 includes a sheet member 90 and a belt 93. The sheet member 90 is attached to the laser printer 1 before shipment to render the first roller 81 to be separated from the second roller 82. As depicted in FIG. 6, the sheet member 90 is formed from a flexible resin sheet. The sheet member 90 is a single sheet that includes a pair of spacers 91 and a joint portion 95 configured to connect the spacers 91 with each other while keeping away from a contact portion between the first roller 81 and the second roller 82. Namely, the sheet member 90 is formed substantially in a "C" shape when viewed from above.

Figure 8:
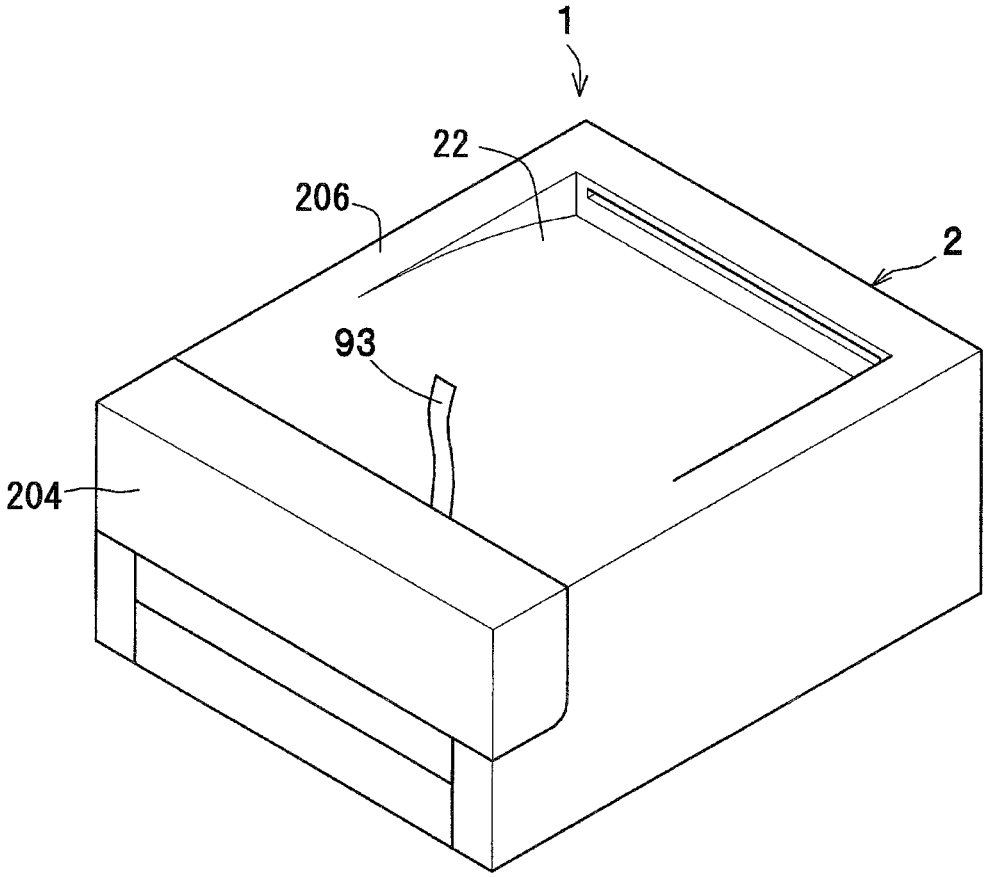
FIG. 8 is an external perspective view of the laser printer in the first embodiment according to one or more aspects of the present invention.

The belt 93, attached to a front end of the joint portion 95, is configured to be grasped by the user when the user removes the sheet member 90. The belt 93 is formed from a flexible resin string and connected with the joint portion 95 at a right side relative to the center of the joint portion 95 in the sheet width direction. As shown in FIG. 8, when the front cover 204 is closed, the belt 93 is sandwiched between the exterior cover 206 and the front cover 204, with such a length as to extend to the outside of the exterior cover 206.

Figure 5:
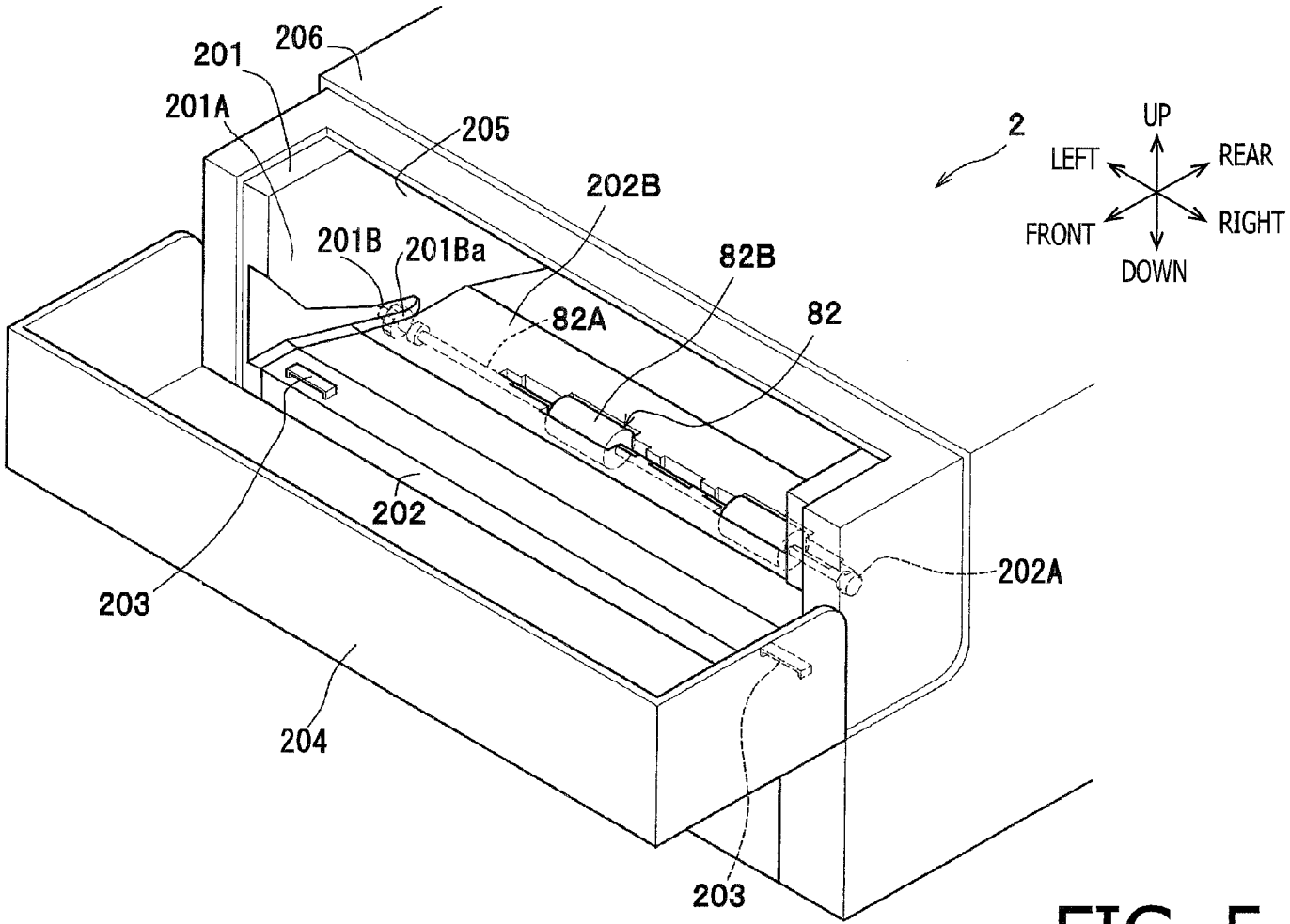
FIG. 5 is a perspective view showing the laser printer in a state where a front cover is opened in the first embodiment according to one or more aspects of the present invention.

There are engagement claws 92 provided at both left and right sides on the spacers 91 or the joint portion 95, respectively. The engagement claws 92 are configured to engage with stoppers 203 (see FIG. 5) provided on the second frame 202, respectively, so as to prevent the sheet member 90 from moving deeply to the rear side in the main body 2. As shown in FIG. 5, each stopper 203 is disposed to be closer to the opening 205 than the feed surface 202B of the second frame 202 for feeding a sheet from the feed tray 31 to the registration rollers 80. Further, the each stopper 203 is formed to protrude from the upper surface of the second frame 202 with a through hole penetrating in the front-to-rear direction. Each engagement claw 92 is formed to be surrounded by a C-shaped groove when viewed in the vertical (up-to-down) direction. Further, each engagement claw 92 is formed with a rear end as a free end. As illustrated in FIG. 6, each engagement claw 92 is inserted, from the free end thereof, into the through hole of a corresponding one of the stoppers 203.

<Method for Attaching Sheet Member>

An explanation will be provided below about a method for attaching the sheet member 90 to the laser printer 1 configured as above. In the factory, after the laser printer 1 (with the process cartridge 6 not yet attached thereto) is completely manufactured, as shown in FIG. 5, when the front cover 204 is opened, an attachment portion to which the process cartridge 6 is to be attached is exposed to the outside. Then, as shown in FIG. 6, the sheet member 90 is placed under the attachment portion of the process cartridge 6 such that the spacers 91 are respectively located at portions, of the lower surfaces 2018 of the recessed portions 201B of the first frames 201, outside the registration rollers 80 in the left-to-right direction. Thereafter, in order to fix the position of the sheet member 90 relative to (the second frame 202 of) the laser printer 1, the engagement claws 92 are engaged with the stoppers 203, respectively. In this state, the joint portion 95 of the sheet member 90 is disposed at a front side near the opening 205 while the spacers 91 of the sheet member 90 extend rearward from there.

When the process cartridge 6 is attached to the predetermined attachment portion via the opening 205, the bearings 81A, which are provided at the both sides of the first roller 81 in the left-to-right direction, are guided by the recessed portions 201B and disposed in positions higher than the second roller 82, respectively. The urging forces of the springs 201C are applied to the bearings 81A, respectively, just before the first roller 81 reaches a position higher than the second roller 82. In this situation, when the process cartridge 6 is pressed against the urging forces, the first roller 81 reaches the position higher than the second roller 82. At this time, the spacers 91 exist between a first level (the bearings 81A and the roller portion 81B of the first roller 81) and a second level (the lower surfaces 201Ba of the recessed portion 201B and the feed surface 202B of the second frame 202). Further, the spacers 91 lift up the bearings 81A and the roller portion 81B against the urging forces of the springs 201C. Therefore, as shown in FIG. 2B, a gap is formed between the roller portion 81B of the first roller 81 and the elastic rollers 82B of the second roller 82.

Figure 7:
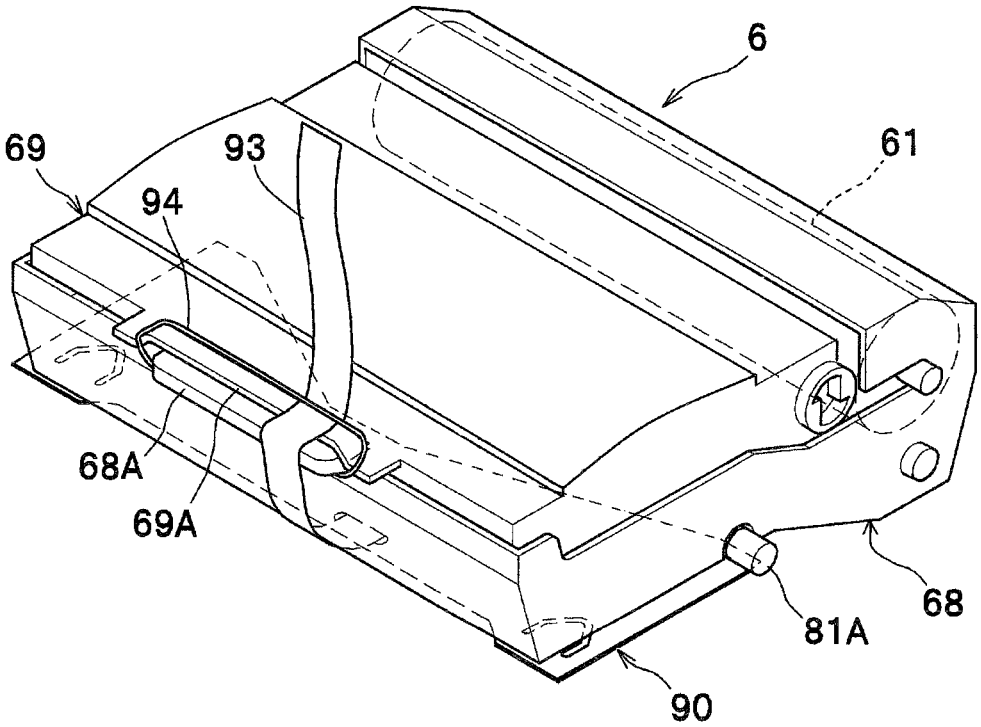
FIG. 7 is a perspective view showing the cartridge, the spacers, and a holding member in the first embodiment according to one or more aspects of the present invention.

Further, as depicted in FIGS. 3 and 7, a holding member 94 such as a rubber band (an elastic band) is hung around a rear-side rising-up portion of the handle 69A and the front wall or the handle 68A of the photoconductive body cartridge 68. Thereby, a restoring force of the holding member 94 pulls in the development cartridge 69 forward relative to the photoconductive body cartridge 68. Thus, it is possible to bring the development roller 64 into a state separated from the photoconductive drum 61 or into contact with the photoconductive drum 61 with a weakened pressing force.

At this time, preferably, the belt 93 may be let go through the holding member 94. When the slack of the belt 93 is taken up, the belt 93 is drawn out to the outside via the opening 205, and the front cover 204 is closed, an end of the belt 93 is exposed outside the laser printer 1 as shown in FIG. 8. This state is a state where the laser printer 1 is before shipment.

<How to Use Laser Printer>

When using the laser printer 1 configured as above, the user can remove the spacers 91 from beneath the first roller 81 by opening the front cover 204 and pulling forward the belt 93 or the sheet member 90. Thereby, the roller portion 81B of the first roller 81 is moved down toward the second roller 82 by the urging forces of the springs 201C and brought into contact with the elastic rollers 82B under a predetermined nipping pressure, such that the registration rollers 80 nip a sheet and become ready to feed the sheet. Further, when the belt 93 is let go through the holding member 94, it is possible to remove the holding member 94 from the handles 68A and 69A of the process cartridge 6 by pulling the belt 93. Thereby, the development roller 64 is brought into contact with the photoconductive drum 61 by the urging force of the urging member 68B.

In the laser printer 1 of the first embodiment, the right-side bearing 202A of the second roller 82 is fixed to a position away from the right-side first frame 201 on the upper wall of the second frame 202 (see FIG. 2). Therefore, when the laser printer 1 is exposed to a high-temperature environment for a long time during transport (for instance, when the laser printer 1 is transported just on the equator by ship), the second frame 202 might be creep-deformed in a state where the right-side bearing 202A pushes down the upper wall of the second frame 202 by the action of the urging forces of the springs 201C applied to the elastic rollers 82B from the first roller 81. Furthermore, when the elastic rollers 82B are made of easily creep-deformed material, the elastic rollers 82B might be deformed by long-time contact with the first roller 81 under the high-temperature environment.

According to the laser printer 1 configured as above, the spacers 91 are disposed between the bearings 81A and the roller portion 81B of the first roller 81, and the lower surfaces 201Ba of the recessed portion 201B and (the feed surface 202B of) the second frame 202. Thus, the first roller 81 is separated from the second roller 82 (namely, there is a gap formed between the first roller 81 and the elastic rollers 82B). Thereby, even though the laser printer 1 is exposed to a high-temperature environment, as there is a predetermined distance of gap between the first roller 81 and the elastic rollers 82B, any urging force, from the first roller 81 via the elastic rollers 82B, is not applied to the second frame 202. Consequently, it is possible to prevent deformation of the second frame 202. Further, it is possible to prevent deformation of the elastic rollers 82B. It is noted that, during transport, the urging forces of the springs 201C are applied, via the first roller 81 and the spacers 91, to the lower surfaces 201Ba of the recessed portion 201B and upper surface areas of the second frame 202 near the lower surfaces 201Ba. Nevertheless, the urging forces of the springs 201C act parallel to the wall surfaces 201A of the first frames 201 in the vicinity of the wall surfaces 201A. Hence, the urging forces of the springs 201C do not deform the lower surfaces 201Ba, the wall surfaces 201A, or upper surface areas of the second frame 202 near the lower surfaces 201Ba. In other words, the urging forces of the springs 201C are allowed to be received by not only the lower surfaces 201Ba but also upper surface areas of the second frame 202 near the wall surfaces 201A. Thus, it is possible to transport the laser printer 1 with the process cartridge 6 attached to the main body 2.

Further, since the two spacers 91 and the joint portion 95 for connecting the two spacers 91 are formed integrally as the single sheet member 90, it is possible to attach and detach the two spacers 91 at a time in a simplified manner.

Further, the sheet member 90 is formed in such a cutaway shape as to keep away from the contact portion between the roller portion 81B of the first roller 81 and the elastic rollers 82B of the second roller 82. Therefore, it is possible to prevent the first roller 81 from pressing the second roller 82. In addition, as the sheet member 90 is cut substantially in a "V" shape, a force for pulling the sheet member 90 is transmitted to the two spacers 91 more easily than in comparison with a sheet member 90 formed in a rectangular "U" shape.

Since the sheet member 90 is connected with the belt 93 extending up to the outside of the closed front cover 204, the user can recognize the belt 93 to be removed. Further, when opening the front cover 204 and seeing the belt 93 connected with the sheet member 90, the user can recognize the sheet member 90 to be removed as well. Preferably, information (characters) that the belt 93 and the sheet member 90 are to be removed may be shown on a part of the belt 93 that protrudes outside the front cover 204, such that the user can recognize it more easily.

The belt 93 may not be required to have such a strength just for making the user recognize the belt 93 to be removed. However, the belt 93 may be formed with a predetermined level of strength. In this case, when pulling the belt 93, the user can remove the spacers 91.

At that time, the belt 93 may be connected with a position of the sheet member 90 off the center of the sheet member 90 in the width direction. Thereby, it is possible to remove the spacers 91 one after the other, and therefore pull out the belt 93 with a less force. Further, it is possible to lessen an impact on the first frames 201.

Since the development cartridge 69 is pulled in toward the front wall of the photoconductive body cartridge 68 by the holding member 94, it is possible to bring the development roller 64 into a state separated from the photoconductive drum 61 or into contact with the photoconductive drum 61 with a weakened contact force.

Further, the belt 93 is let go through the holding member 94. Therefore, when the belt 93 is pulled, the holding member 94 is removed from the process cartridge 6. Thus, the user can be relieved from a troublesome operation.

<Second Embodiment>

Figure 9A:
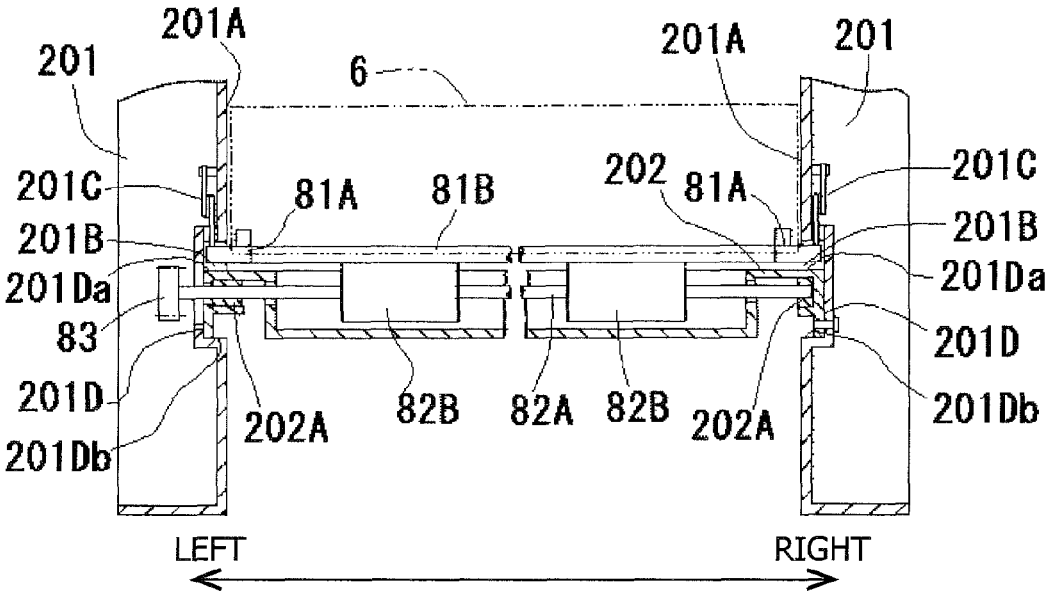
FIG. 9A is a cross-sectional view showing a frame structure of the laser printer along the II-II plane shown in FIG. 1 in a second embodiment according to one or more aspects of the present invention.
Figure 9B:
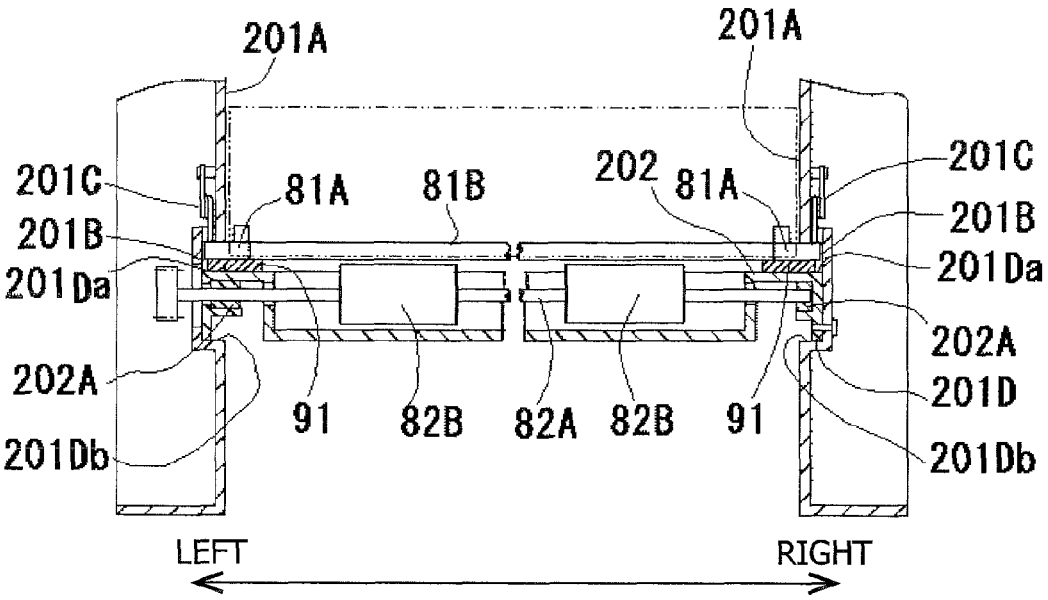
FIG. 9B is a cross-sectional view showing a frame structure of the laser printer with the spacers attached thereto in the second embodiment according to one or more aspects of the present invention.

FIGS. 9A and 9B show a second embodiment, in which the same elements as shown in the first embodiment will be indicated with the same reference characters attached thereto and an explanation of them will be omitted. In the second embodiment, each of recessed portions 201D of the first frames 201 for accepting the bearings 81A is formed with such a size as to accept a corresponding one of both ends of the second frame 202 in the sheet width direction. Therefore, the ends of the second frame 202 in the sheet width direction are fixed relative to the first frames 201 while being inserted into the recessed portions 201D, respectively. Lower surfaces 201Da of the recessed portions 201D for accepting the bearings 81A are configured with upper surface areas of the second frame 202, respectively. Accordingly, a feed surface, which is an upper surface of the second frame 202 near the elastic rollers 82B, is located as high as the lower surfaces 201Da.

The bearings 202A of the second roller 82 are supported by walls of the ends of the second frame 202 which ends are inserted into the recessed portions 201D. By such a configuration, the bearings 202A of the second roller 82 transmit pressures with which the first roller 81 contacts (presses) the elastic rollers 82B to lower walls 201Db of the recessed portions 201D, respectively. Thus, even though the spacers 91 are not employed during transport, the second frame 202 is hardly deformed by the urging forces of the springs 201C. Further, the forces, applied to the lower walls 201Db of the recessed portions 201D, act along the wall surfaces 201A of the first frames 201, respectively, and therefore hardly deform the first frames 201.

In the case where the elastic rollers 82B of the second roller 82 might be deformed due to contact with the first roller 81 under a high-temperature environment, preferably, the first roller 81 may be separated from the elastic rollers 82B with the spacers 91 sandwiched between the first roller 81 and the upper surface of the second frame 202, as shown in FIG. 9B.

In the second embodiment, the bearings 202A of the second roller 82 may be fixed onto a lower surface of the upper wall of the second frame 202 in a position away from the first frames 201 as exemplified in the first embodiment. In this case, the spacers 91 may be employed to prevent deformation of the second frame 202 in the same manner as shown in the first embodiment.

<Third Embodiment>

Figure 10:
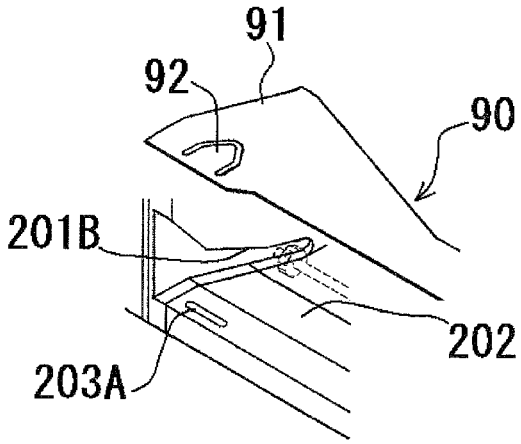
FIG. 10 is a perspective view partially showing the laser printer and one of the spacers to be attached to the laser printer in a third embodiment according to one or more aspects of the present invention.

FIG. 10 shows a third embodiment, in which the same elements as shown in the first embodiment will be indicated with the same reference characters attached thereto and an explanation of them will be omitted. In the third embodiment, each engagement claw 92, configured to prevent the sheet member 90 from moving deeply to the rear side in the main body 2, engages with a long-hole-shaped stopper 203A formed to penetrate the upper surface of the second frame 202. In this case, the engagement claw 92 is inserted into the long-hole-shaped stopper 203A with the free end thereof being bent down.

<Fourth Embodiment>

Figure 11:
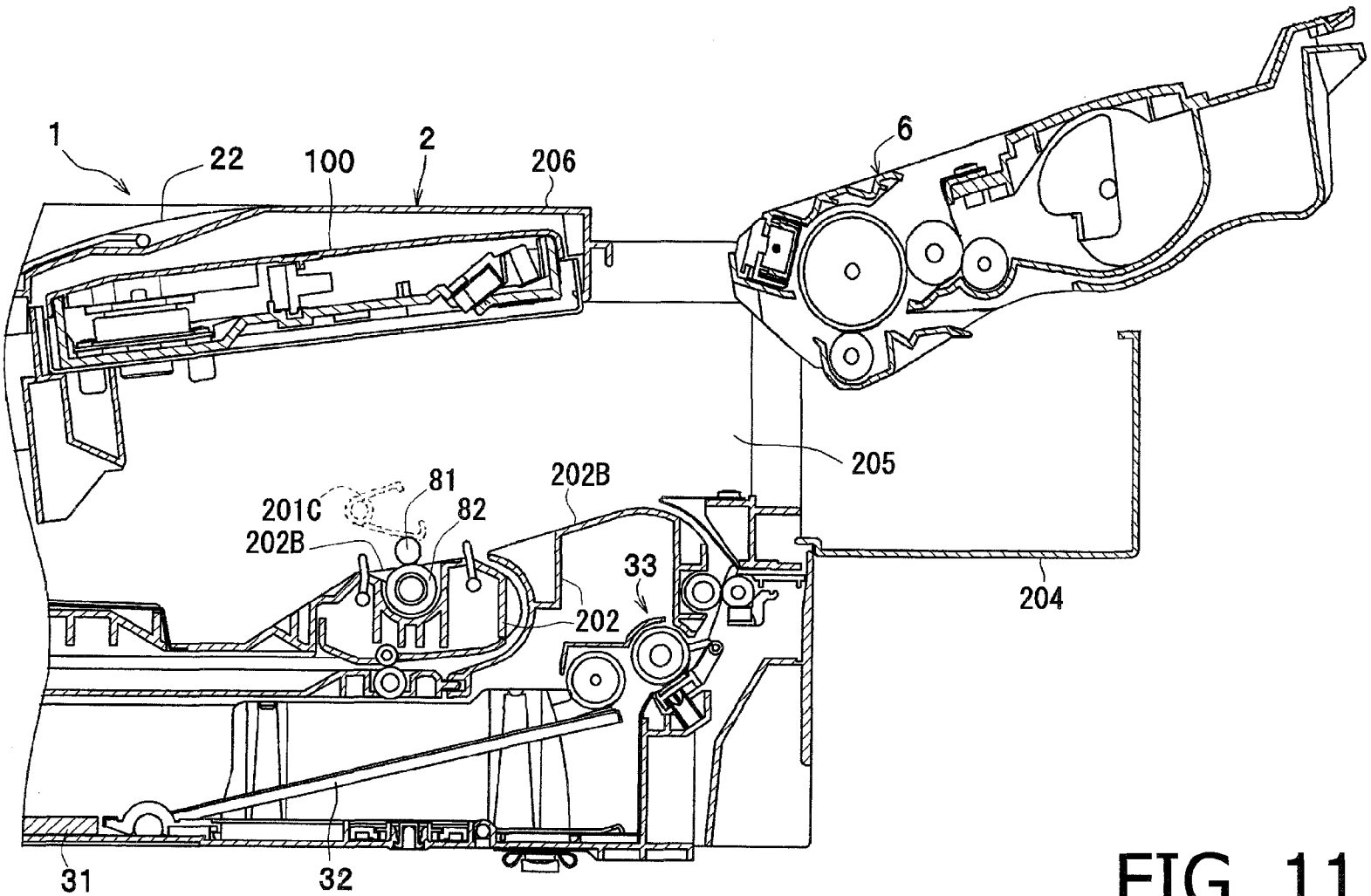
FIG. 11 is a cross-sectional side view showing an internal configuration of the laser printer to (from) which the cartridge is being attached (detached) in a fourth embodiment according to one or more aspects of the present invention.

FIG. 11 shows a fourth embodiment, in which the same elements as shown in the first embodiment will be indicated with the same reference characters attached thereto and an explanation of them will be omitted. In the fourth embodiment, the bearings 81A of the first roller 81 are supported by not the process cartridge 6 but the wall surfaces 201A of the first frames 201. In this case, the bearings 81A are supported movably in the vertical direction by long holes formed on the wall surfaces 201A to be elongated in the vertical direction, and urged by the springs 201C in such a direction as to contact the second roller 82, respectively. Further, in order to attach the spacers 91, the user is required to lift up the first roller 81 against the urging forces of the springs 201C and insert the spacers 91 between the second frame 202 and portions of the first roller 81 near the bearings 81A, such that the first roller 81 is separated from the second roller 82.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

<Modifications>

In each of the aforementioned embodiments, during transport, the first roller 81 is separated from the elastic rollers 82B with the spacers 91 inserted therebetween. However, the spacers 91 may be placed to slightly lift the spacers 91 so as to weaken the pressure (the contact force) between the first roller 81 and the elastic rollers 82B. Thereby, since the pressure between the first roller 81 and the elastic rollers 82B is weakened, it is possible to prevent deformation of the second frame 202.

The two spacers 91 do not necessarily have to be provided to correspond to the both ends of the first roller 81. Only a single spacer 91 may be employed. For instance, when the left-side bearing 202A is disposed near the left-side first frame 201 as illustrated in FIGS. 2A and 2B, the left-side spacer 91 may be omitted. Further, the belt 93 may be connected with one of the spacers 91, and the joint portion 95 may be omitted.

Further, instead of the rubber band as exemplified as the holding member 94 in the aforementioned embodiments, a substantially closed-ring-shaped spring member or a U-shaped clip may be employed. Additionally, the belt 93 does not necessarily have to go through the holding member 94. The belt 93 may be joined with an outer surface of the holding member 94 and a clip.

In each of the aforementioned embodiments, aspects of the present invention are applied to the laser printer 1 configured to form a single-color image. However, aspects of the present invention may be applied to a copy machine or a multi-function peripheral.

What is claimed is:

1. An image forming apparatus comprising:

a main body comprising:

two first frames disposed to face each other; and a second frame disposed to bridge a gap between the two first frames;

an image forming unit disposed between the two first frames;

a feed roller unit configured to feed a sheet passing through the image forming unit in a sheet feeding direction, the feed roller unit comprising:

a first roller having a first rotational axis line extending in such a direction as to bridge the gap between the two first frames; and a second roller having a second rotational axis line substantially parallel to the first rotational axis line, the second roller being configured to contact the first roller;

an urging member configured to provide an urging force in an urging direction substantially parallel to the first frames so as to bring the first roller and the second roller into contact with each other; and a sheet-shaped spacer detachably attached in a manner directly pinched between the main body and one of the first roller and the second roller, so as to lead to one of separating the first roller from the second roller and weakening a contact force between the first roller and the second roller, against the urging force provided by the urging member, the sheet-shaped spacer comprising:

two sheet-shaped spacer members provided to correspond to both ends of the first roller in a rotational axis direction of the first roller, respectively; and a sheet-shaped joint portion configured to connect the two sheet-shaped spacer members with each other while keeping away from a contact portion between the first roller and the second roller.

2. The image forming apparatus according to claim 1, wherein at least one end of the second roller in a direction along the second rotational axis line is supported by the second frame in a position away from one of the two first frames toward the other first frame, and wherein the first roller is urged by the urging member in such a direction as to contact the second roller.

3. The image forming apparatus according to claim 2, wherein the second roller is configured to partially contact the sheet fed by the feed roller unit in a sheet width direction perpendicular to the sheet feeding direction, wherein the first roller is configured as a rod-shaped roller extending over an entire length of the sheet in the sheet width direction, at least one end of the first roller in a direction along the first rotational axis line being urged by the urging member in such a direction as to contact the second roller.

4. The image forming apparatus according to claim 1, wherein the two first frames comprise wall surfaces parallel to each other, respectively, and wherein the urging force provided by the urging member is applied to the sheet-shaped spacer in a direction parallel to the wall surfaces, near the wall surfaces.

5. The image forming apparatus according to claim 4, wherein each first frame comprises a recessed portion formed on the wall surface, the recessed portion being configured such that an end of the first roller in a direction along the first rotational axis line is inserted therein, wherein the urging member urges the end of the first roller inserted in the recessed portion of each first frame, and wherein at least a part of the sheet-spaced spacer is disposed between an end of the first roller in the direction along the first rotational axis line and a side surface of the recessed portion in which the end of the first roller is inserted, the side surface being on a side closer to the second roller.

6. The image forming apparatus according to claim 5, wherein the second frame has a surface on a side closer to the first roller as a feed surface for feeding thereon the sheet fed by the feed roller unit, wherein the side surface of the recessed portion on the side closer to the second roller is disposed in a position substantially continuous with the feed surface of the second frame, and wherein the sheet-shaped spacer is disposed across the side surface of the recessed portion on the side closer to the second roller and the feed surface of the second frame.

7. The image forming apparatus according to claim 1, wherein the second frame comprises a feed surface for feeding thereon the sheet fed by the feed roller unit, at least in the vicinity of the second roller.

8. The image forming apparatus according to claim 1, wherein the image forming unit comprises a cartridge detachably attached between the two first frames, the cartridge comprising a photoconductive drum, and wherein the first roller is supported by the cartridge and configured to be detachably attachable together with the cartridge.

9. The image forming apparatus according to claim 8,
wherein at least one end of the first roller in a direction along the first rotational axis line protrudes from the cartridge toward one of the first frames,
wherein the one of the first frames comprises the urging member, and
wherein, in a state where the cartridge is attached between the first frames, the urging member urges the at least one end of the first roller that protrudes from the cartridge, toward the second roller.

10. The image forming apparatus according to claim 8, wherein the first roller is supported by the cartridge to be movable in the urging direction of the urging member, and urged by the urging member toward the second roller in a state where the cartridge is attached between the first frames.

11. The image forming apparatus according to claim 8,
wherein the cartridge comprises a photoconductive body cartridge that comprises the photoconductive drum, and a development cartridge that comprises a development roller, the development cartridge being urged against the photoconductive body cartridge in such a direction that the photoconductive body drum and the development roller press each other,
wherein the image forming apparatus further comprises a holding member attached thereto to move the development cartridge relative to the photoconductive body cartridge in such a direction as to lead to one of separating the development roller from the photoconductive drum and weakening a pressing force between the development roller and the photoconductive drum and to hold a state of the development cartridge moved relative to the photoconductive body cartridge,
wherein the sheet-shaped spacer is connected with an extension member that extends from the sheet-shaped spacer up to an outside of the main body, and
wherein the holding member is attached to operate in cooperation with the extension member.

12. The image forming apparatus according to claim 11,
wherein the holding member is formed in a ring shape, and
wherein the extension member passes through the ring-shaped holding member.

13. The image forming apparatus according to claim 1, wherein the first roller is supported by the first frames movably in the urging direction of the urging member, and urged by the urging member toward the second roller.

14. The image forming apparatus according to claim 1,
wherein the first roller comprises a roller portion configured to feed the sheet and a pair of bearings configured to rotatably support both ends of the roller portion in a rotational axis direction of the roller portion,
wherein the urging member urges the bearings, and
wherein the sheet-shaped spacer contacts the bearings.

15. The image forming apparatus according to claim 1,
wherein the main body comprises a cover configured to be openable and closable relative to the main body and to cover an end of a space between the two first frames when closed, and
wherein the sheet-shaped joint portion is disposed to be closer to the cover than the two sheet-shaped spacer members.

16. The image forming apparatus according to claim 1, wherein the sheet-shaped joint portion is connected with an extension member that extends from a position off a center of the sheet-shaped joint portion in a sheet width direction perpendicular to the sheet feeding direction up to an outside of the main body.

17. The image forming apparatus according to claim 1, wherein the sheet-shaped spacer is connected with an extension member that extends up to an outside of the main body.

18. A transport tool for transporting an image forming apparatus comprising:
an image forming unit;
a feed roller unit configured to feed a sheet passing through the image forming unit in a sheet feeding direction, the feed roller unit comprising a first roller and a second roller, the first roller being urged in such a direction as to contact the second roller, the second roller comprising a roller portion disposed within a length of the sheet in a sheet width direction perpendicular to the sheet feeding direction, the roller portion being configured to contact the first roller; and
a frame supporting the image forming unit and the feed roller unit,
the transport tool comprising a spacer configured to be detachably attached in a manner directly pinched between the first roller and the frame so as to lead to one of separating the first roller from the second roller and weakening a contact force between the first roller and the second roller, the spacer comprising:
two spacer members provided to correspond to both ends of the first roller outside the roller portion of the second roller in the sheet width direction, respectively; and
a joint portion configured to connect the two spacer members with each other while keeping away from a contact portion between the first roller and the second roller,
wherein the joint portion and the two spacer members are formed in a sheet shape.

19. The transport tool according to claim 18, wherein the spacer is connected with a flexible extension member that has such a length as to extend up to an outside of the image forming apparatus when the spacer is attached between the first roller and the frame.

20. An image forming apparatus comprising:
a main body comprising:
two first frames disposed to face each other; and
a second frame disposed to bridge a gap between the two first frames;
an image forming unit disposed between the two first frames;
a feed roller unit configured to feed a sheet passing through the image forming unit in a sheet feeding direction, the feed roller unit comprising:
a first roller having a first rotational axis line extending in such a direction as to bridge the gap between the two first frames; and
a second roller having a second rotational axis line substantially parallel to the first rotational axis line, the second roller being configured to contact the first roller;
an urging member configured to provide an urging force in an urging direction substantially parallel to the first frames so as to bring the first roller and the second roller into contact with each other; and
a spacer detachably attached in a manner directly pinched between the main body and one of the first roller and the second roller, so as to lead to one of separating the first roller from the second roller and weakening a contact force between the first roller and the second roller, against the urging force provided by the urging member, the spacer comprising:

two spacer members provided to correspond to both ends of the first roller in a rotational axis direction of the first roller, respectively; and a joint portion configured to connect the two spacer members with each other while keeping away from a contact portion between the first roller and the second roller, the joint portion being connected with an extension member that extends from a position off a center of the joint portion in a sheet width direction perpendicular to the sheet feeding direction up to an outside of the main body.

21. An image forming apparatus comprising:

a main body comprising:

two first frames disposed to face each other, the two first frames comprising wall surfaces parallel to each other, respectively; and a second frame disposed to bridge a gap between the two first frames;

an image forming unit disposed between the two first frames;

a feed roller unit configured to feed a sheet passing through the image forming unit in a sheet feeding direction, the feed roller unit comprising:

a first roller having a first rotational axis line extending in such a direction as to bridge the gap between the two first frames; and a second roller having a second rotational axis line substantially parallel to the first rotational axis line, the second roller being configured to contact the first roller;

an urging member configured to provide an urging force in an urging direction substantially parallel to the first frames so as to bring the first roller and the second roller into contact with each other, the urging force being applied to the spacer in a direction parallel to the wall surfaces, near the wall surfaces; and a spacer detachably attached in a manner directly pinched between the main body and one of the first roller and the second roller, so as to lead to one of separating the first roller from the second roller and weakening a contact force between the first roller and the second roller, against the urging force provided by the urging member, wherein each first frame comprises a receded portion formed on the wall surface, the recessed portion being configured such that an end of the first roller in a direction along the first rotational axis line is inserted therein, wherein the urging member urges the end of the first roller inserted in the recessed portion of each first frame, and wherein at least a part of the spacer is disposed between an end of the first roller in the direction along the first rotational axis line and a side surface of the recessed portion in which the end of the first roller is inserted, the side surface being on a side closer to the second roller.

22. The image forming apparatus according to claim 7, wherein the second frame comprises an opening formed on the feed surface, and wherein the second roller is partially exposed to a side of the first roller through the opening.

* * * * *